US011195463B2

(12) United States Patent
Yue et al.

(10) Patent No.: US 11,195,463 B2
(45) Date of Patent: Dec. 7, 2021

(54) PIXEL DRIVING CIRCUIT, PIXEL DRIVING METHOD, DISPLAY PANEL AND DISPLAY DEVICE

(71) Applicant: BOE TECHNOLOGY GROUP CO., LTD., Beijing (CN)

(72) Inventors: Han Yue, Beijing (CN); Minghua Xuan, Beijing (CN); Can Zhang, Beijing (CN); Can Wang, Beijing (CN); Ning Cong, Beijing (CN); Xiaochuan Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/839,590

(22) Filed: Apr. 3, 2020

(65) Prior Publication Data

US 2021/0097931 A1 Apr. 1, 2021

(30) Foreign Application Priority Data

Sep. 26, 2019 (CN) ..... 201910918518.6

(51) Int. Cl.
*G09G 3/325* (2016.01)
*G09G 3/3291* (2016.01)
*G09G 3/36* (2006.01)

(52) U.S. Cl.
CPC ..... *G09G 3/325* (2013.01); *G09G 3/3291* (2013.01); *G09G 3/3659* (2013.01)

(58) Field of Classification Search
CPC .... G09G 3/325; G09G 3/3291; G09G 3/3659; G09G 3/3258
See application file for complete search history.

(56) References Cited

U.S. PATENT DOCUMENTS 7,903,053 B2 * 3/2011 Kawasaki ..... G09G 3/3283 345/76
8,723,763 B2 * 5/2014 Jeong ..... G09G 3/3291 345/82

(Continued)

FOREIGN PATENT DOCUMENTS

CN 104464638 A 3/2015
CN 104778915 A 7/2015

(Continued)

OTHER PUBLICATIONS

Office Action of CN Application No. 201910918518.6 and English translation, dated Aug. 5, 2020, 16 pages.

(Continued)

*Primary Examiner* — Michael J Jansen, II
(74) *Attorney, Agent, or Firm* — Muncy, Geissler, Olds & Lowe, P.C.

(57) ABSTRACT

A pixel driving circuit includes a current control circuit and a time control circuit, the current control circuit controls to generate a driving current, and outputs the driving current through a driving current output terminal, the time control circuit includes a first data writing-in circuit and a driving time control circuit. The first data writing-in circuit writes a first data voltage provided by a first data line to the driving time control circuit under the control of a first gate driving signal provided by a first gate line. The driving time control circuit is connected to a reference voltage terminal, the current control circuit, the first data writing-in circuit, and a light emitting element, and controls a light emitting time period of the light emitting element based on the reference voltage and the first data voltage, the reference voltage terminal is used to provide the reference voltage.

17 Claims, 6 Drawing Sheets

(56) References Cited

U.S. PATENT DOCUMENTS

| | | | | |
|---|---|---|---|---|
| 9,123,294 | B2 * | 9/2015 | Han | G09G 3/3233 |
| 9,721,507 | B2 * | 8/2017 | Han | G09G 3/3233 |
| 9,761,173 | B2 * | 9/2017 | Han | G09G 3/3233 |
| 9,984,615 | B2 * | 5/2018 | Hu | G09G 3/3225 |
| 10,157,571 | B2 * | 12/2018 | Zhu | G09G 3/3233 |
| 10,170,043 | B2 * | 1/2019 | Yin | H05B 45/00 |
| 10,210,802 | B2 * | 2/2019 | Li | G09G 3/3233 |
| 10,339,865 | B2 * | 7/2019 | Chen | G09G 3/3291 |
| 10,607,542 | B2 * | 3/2020 | Zhu | G09G 3/3258 |
| 10,657,890 | B2 * | 5/2020 | Liu | G09G 3/3291 |
| 10,984,706 | B2 * | 4/2021 | Lin | G09G 3/3233 |
| 2003/0020413 | A1 * | 1/2003 | Oomura | G09G 3/3241 315/169.3 |
| 2006/0132395 | A1 * | 6/2006 | Kawasaki | G09G 3/3283 345/75.2 |
| 2008/0042937 | A1 * | 2/2008 | Shikina | G09G 3/3266 345/76 |
| 2010/0060626 | A1 * | 3/2010 | Wang | G09G 3/3233 345/214 |
| 2011/0050741 | A1 * | 3/2011 | Jeong | G09G 3/3291 345/690 |
| 2011/0050761 | A1 * | 3/2011 | Yoneyama | G09G 3/325 345/698 |
| 2013/0043802 | A1 * | 2/2013 | Han | G09G 3/3233 315/240 |
| 2016/0189604 | A1 * | 6/2016 | Hu | G09G 3/3225 345/215 |
| 2016/0358547 | A1 * | 12/2016 | Zhu | G09G 3/3233 |
| 2017/0263180 | A1 * | 9/2017 | Zhu | G09G 3/3233 |
| 2018/0061318 | A1 * | 3/2018 | Yin | H05B 45/00 |
| 2018/0158404 | A1 * | 6/2018 | Li | G09G 3/3233 |
| 2019/0019452 | A1 * | 1/2019 | Zhu | G09G 3/3266 |
| 2019/0122609 | A1 * | 4/2019 | Liu | G09G 3/3233 |
| 2020/0342809 | A1 * | 10/2020 | Park | G09G 3/3258 |
| 2020/0394952 | A1 * | 12/2020 | Na | G09G 3/32 |
| 2021/0027699 | A1 * | 1/2021 | Zheng | G09G 3/3233 |
| 2021/0097931 | A1 * | 4/2021 | Yue | G09G 3/325 |
| 2021/0225262 | A1 * | 7/2021 | Liu | G09G 3/2022 |

FOREIGN PATENT DOCUMENTS

| | | | |
|---|---|---|---|
| CN | 105788531 | A | 7/2016 |
| CN | 106409233 | A | 2/2017 |
| CN | 110010057 | A | 7/2019 |
| GB | 2493800 | A | 2/2013 |
| KR | 20070013576 | A | 1/2007 |

OTHER PUBLICATIONS

Lin et al., "Analysis for Suppressing Shift of Threshold Voltage of OLED Pixel Driving Transistor" and English translation, Technology Research, 2013, pp. 422-424 and 439, 15 pages.

Wang et al., "A-IGZO Thin-film Transistors Integrated AMOLED Pixel Circuit with Data Line Controlled Light-emitting," Chinese Journal of Luminescence, vol. 39, No. 11, Nov. 2018, pp. 1549-1556, 8 pages.

* cited by examiner

PIXEL DRIVING CIRCUIT, PIXEL DRIVING METHOD, DISPLAY PANEL AND DISPLAY DEVICE

CROSS-REFERENCE TO RELATED APPLICATION

The present application claims a priority of the Chinese patent application No. 201910918518.6 filed on Sep. 26, 2019, which is incorporated herein by reference in its entirety.

TECHNICAL FIELD

The present disclosure relates to the field of a display technology, and especially to a pixel driving circuit, a pixel driving method, a display panel and a display device.

BACKGROUND

In the self-luminous display control technology, since the current control ability is limited, it is difficult to take into account both high brightness and high contrast. Therefore, the gray level needs to be controlled simultaneously by current and time. However, in the prior art, due to different threshold voltages of different light emitting elements in a display panel and different threshold voltages of a first driving transistor in a time control circuit, a problem of uneven display may occur.

SUMMARY

An object of the present disclosure is to provide a pixel driving circuit, a pixel driving method, a display panel and a display device, so as to solve the problem of uneven display due to different threshold voltages of different light emitting elements in a display panel and different threshold voltages of a first driving transistor in a time control circuit.

In one aspect, the present disclosure provides in some embodiments a pixel driving circuit, including a current control circuit and a time control circuit, the current control circuit is configured to control to generate a driving current, and output the driving current through a driving current output terminal, the time control circuit comprises a first data writing-in circuit and a driving time control circuit, the first data writing-in circuit is configured to write a first data voltage provided by a first data line to the driving time control circuit under the control of a first gate driving signal provided by a first gate line, the driving time control circuit is electrically connected to a reference voltage terminal, the current control circuit, the first data writing-in circuit, and a light emitting element, respectively, and is configured to control a time period during which the light emitting element is driven to emit light by the driving current based on the reference voltage and the first data voltage, the reference voltage terminal is used to provide the reference voltage.

During implementation, the driving time control circuit includes a voltage input circuit, a first driving circuit, a first compensation circuit, a first initialization circuit, and a time control capacitor, the voltage input circuit is configured to control to provide the reference voltage to a second terminal of the time control capacitor under the control of a light emitting signal provided by a light emitting control line; a control terminal of the first driving circuit is electrically connected to a first terminal of the time control capacitor, and a first terminal of the first driving circuit is respectively connected to a driving current output terminal of the current control circuit and the first data writing-in circuit, a second terminal of the first driving circuit is electrically connected to the light emitting element, and the first driving circuit is configured to control the connection of the first terminal of the first driving circuit and the second terminal of the first driving circuit under the control of a potential of the control terminal of the first driving circuit, the first data writing-in circuit is configured to write the first data voltage to the first terminal of the first driving circuit, the first compensation circuit is configured to control the connection of the control terminal of the first driving circuit and the second terminal of a first driving circuit under the control of a first gate driving signal, control to provide a preset voltage to the first electrode of the light emitting element, and control the connection of the second electrode of the light emitting element and the second terminals of the time control capacitor, the first initialization circuit is configured to reset a potential of the first terminal of the time control capacitor and a potential of the second terminal of the time control capacitor under the control of a first reset control signal provided by a first reset control line.

During implementation n the driving time control circuit includes a first light emitting control circuit, the first light emitting control circuit is configured to control the connection of the second terminal of the first driving circuit and the first electrode of the light emitting element under the control of a light emitting control signal provided by a light emitting control line, and control the connection of the second electrode of the light emitting element and the first voltage terminal.

During implementation, the first data writing-in circuit includes a first data writing-in transistor, a control electrode of the first data writing-in transistor is electrically connected to a first gate line, a first electrode of the first data writing-in transistor is electrically connected to the first data line, and a second electrode of the first data writing-in transistor is electrically connected to the driving time control circuit.

During implementation, the voltage input circuit includes a voltage input transistor, a control electrode of the voltage input transistor is electrically connected to the light emitting control line, a first electrode of the voltage input transistor is electrically connected to the reference voltage terminal, and a second electrode of the voltage input transistor is connected to a first electrode of the time control capacitor.

During implementation, the first driving circuit includes a first driving transistor, a control electrode of the first driving transistor is electrically connected to a first terminal of the time control capacitor, and a first electrode of the first driving transistor is respectively connected to a driving current output terminal of the current control circuit and the first data writing-in circuit, and a second electrode of the first driving transistor is electrically connected to the light emitting element.

During implementation, the first compensation circuit includes a first compensation transistor, a second compensation transistor, and a third compensation transistor, a control electrode of the first compensation transistor is electrically connected to the first gate line, a first electrode of the first compensation transistor is electrically connected to a control terminal of the first driving circuit, and a second electrode of the first compensation transistor is electrically connected to the second terminal of the first driving circuit, a control electrode of the second compensation transistor is electrically connected to the first gate line, a first electrode of the second compensation transistor is electrically connected to a preset voltage terminal, and a second electrode of the second compensation transistor is connected to the first electrode of the light emitting element, a control electrode of the third compensation transistor is electrically connected to the first gate line, a first electrode of the third compensation transistor is electrically connected to a second electrode of the light emitting element, and a second electrode of the third compensation transistor is electrically connected to the second terminal of the time control capacitor.

During implementation, the first initialization circuit includes a first initialization transistor and a second initialization transistor, a control electrode of the first initialization transistor is electrically connected to the first reset control line, a first electrode of the first initialization transistor is electrically connected to a first terminal of the time control capacitor, and a second electrode of the first initialization transistor is electrically connected to the first initialization voltage terminal, a control electrode of the second initialization transistor is electrically connected to the first reset control line, a first electrode of the second initialization transistor is electrically connected to the second terminal of the time control capacitor, and a second electrode of the second initialization transistor is electrically connected to a second initialization voltage terminal.

During implementation, the first light emitting control circuit includes a first light emitting control transistor and a second light emitting control transistor, a control electrode of the first light emitting control transistor is electrically connected to the light emitting control line, a first electrode of the first light emitting control transistor is electrically connected to a second terminal of the first driving circuit, and the second electrode of the first light emitting control transistor is electrically connected to the first electrode of the light emitting element, a control electrode of the second light emitting control transistor is electrically connected to the light emitting control line, a first electrode of the second light emitting control transistor is electrically connected to a second electrode of the light emitting element, and a second electrode of the second light emitting control transistor is electrically connected to the first voltage terminal.

During implementation, the current control circuit includes a second driving circuit, a second initialization circuit, a second data writing-in circuit, a current control capacitor, a second light emitting control circuit, and a second compensation circuit, the second light emitting control circuit is configured to control the connection of a first terminal of the second driving circuit and a first terminal of the current control capacitor under the control of a light emitting control signal inputted by a light emitting control line, and control the connection of a second terminal of the second driving circuit and a driving current output terminal, a second terminal of the current control capacitor is electrically connected to a control terminal of the second driving circuit, the second driving circuit is configured to control the connection of the first terminal of the second driving circuit and the second terminal of the second driving circuit under the control of a potential of the control terminal of the second driving circuit, the second data writing-in circuit is configured to control the connection of a second data line and the first terminal of the second driving circuit under the control of a second gate driving signal provided by a second gate line, the second compensation circuit is configured to control the connection of the control terminal of the second driving circuit and the second terminal of the second driving circuit under the control of the second gate driving signal, and the second initialization circuit is configured to control the connection of a third initialization voltage terminal and the control terminal of the second driving circuit under the control of a second reset control signal provided by a second reset control line.

During implementation, the second driving circuit includes a second driving transistor, a first terminal of the current control capacitor is electrically connected to a power supply voltage terminal, a control electrode of the second driving transistor is a control terminal of the second driving circuit, a first electrode of the second driving transistor is a first terminal of the second driving circuit, and a second electrode of the second driving transistor is a second terminal of the second driving circuit, the second data writing-in circuit comprises a second data writing-in transistor, a control electrode of the second data writing-in transistor is electrically connected to a second gate line, a first electrode of the second data writing-in transistor is electrically connected to a second data line, and a second electrode of the second data writing-in transistor is electrically connected to the first electrode of the second driving transistor, the second compensation circuit comprises a fourth compensation transistor, a control electrode of the fourth compensation transistor is electrically connected to the second gate line, a first electrode of the fourth compensation transistor is electrically connected to a control terminal of the second driving circuit, and a second electrode of the fourth compensation transistor is electrically connected to the second terminal of the second driving circuit, the second light emitting control circuit comprises a third light emitting control transistor and a fourth light emitting control transistor, a control electrode of the third light emitting control transistor is electrically connected to the light emitting control line, a first electrode of the third light emitting control transistor is electrically connected to a first terminal of the second driving circuit, and a second electrode of the third light emitting control transistor is electrically connected to the first terminal of the current control capacitor, a control electrode of the fourth light emitting control transistor is electrically connected to the light emitting control line, a first electrode of the fourth light emitting control transistor is electrically connected to the second terminal of the second driving circuit, and a second electrode of the fourth light emitting control transistor is electrically connected to a driving current output terminal.

During implementation, the second initialization circuit includes a third initialization transistor, a control electrode of the third initialization transistor is electrically connected to a second reset control line, a first electrode of the third initialization transistor is electrically connected to a third initialization voltage terminal, and a second electrode of the third initialization transistor is connected to the control terminal of the second driving circuit.

In another aspect, a pixel driving method for driving the pixel driving circuit includes: generating, by a current control circuit, a driving current and outputting the driving current through a driving current output terminal, controlling, by a driving time control circuit, a light emitting time period of the light emitting element driven by the driving current based on a reference voltage and a first data voltage.

During implementation, the display time includes a first phase, a time reset phase, a time charging phase, and a light emitting phase, the driving time control circuit includes a voltage input circuit, a first driving circuit, a first compensation circuit, a time control capacitor, and a first initialization circuit, the pixel driving method includes: in the first stage, controlling, by the current control circuit, to write a second data voltage to a control terminal of a second driving circuit included in the current control circuit; in the time reset phase, controlling, by the first initialization circuit, to reset a potential of a first terminal of the time control capacitor and a potential of a second terminal of the time control capacitor; in the time charging phase, under the control of a first gate driving signal provided by a first gate line, controlling, by the first data writing-in circuit, to write a first data voltage Vdata1 provided by a first data line to a first terminal of the first driving circuit, controlling, by the first compensation circuit, the connection of a control terminal of the first driving circuit and a second terminal of the first driving circuit, and to provide a preset voltage Common1 to a first electrode of the light emitting element, and controlling the connection of a second electrode of the light emitting element and a second terminal of the time control capacitor, so that a potential of the second terminal of the time control capacitor becomes Common1−Vf, and Vf is the threshold voltage of the light emitting element; controlling, by the first driving circuit, the connection of the first terminal of the first driving circuit and the second terminal of the first driving circuit, and charging the time control capacitor by the compensation control voltage through the first driving circuit in an on state until the potential of the control terminal of the first driving circuit becomes Vdata1+Vth1, Vth1 is a threshold voltage of a first driving transistor included in the first driving circuit; and in the light emitting phase, generating, by the current control circuit, a driving current based on a second data voltage and outputting the driving current through a driving current output terminal; controlling, by the voltage input circuit, to provide a reference voltage Vref to the second terminal of the time control capacitor under the control of a light emitting control signal provided by a light emitting control line EM, so as to control the potential of the control terminal of the first driving circuit to jump to Vdata1+Vref−Common1+Vf+Vth1.

During implementation, the first phase includes a current reset phase and a current charging phase, and the current control circuit includes a second driving circuit, a second initialization circuit, a second data writing-in circuit, a current control capacitor, and a second light emitting control circuit and a second compensation circuit, the pixel driving method includes: in the current reset phase, controlling, by the second initialization circuit, to reset a potential of a control terminal of the second driving circuit under the control of a second reset control signal, so that at the beginning of the current charging phase, the second driving circuit connects a first terminal and a second terminal of the second driving circuit; and in the current charging phase, controlling, by the second data writing-in circuit, the connection of a second data line and a first terminal of the second driving circuit under the control of a second gate driving signal provided by a second gate line Gate, so as to write a second data voltage Vdata2 on a second data line to the first terminal of the second driving circuit, controlling, by the second driving circuit, the connection of the first terminal and the second terminal of the second driving circuit, and controlling, by the second compensation circuit, the connection of the control terminal of the second driving circuit and the second terminal of the second driving circuit; to charge the current control capacitor through Vdata2 to increase a potential of the control terminal of the second driving circuit until the second driving circuit disconnects the first terminal and the second terminal of the second driving circuit, at this time the potential of the control terminal of the second driving circuit being Vdata2+Vth2, and Vth2 being a threshold voltage of a second driving transistor in the second driving circuit.

In yet another aspect, a display panel includes the above pixel driving circuit.

In still yet another aspect, a display device includes the above display panel.

DETAILED DESCRIPTION

The technical solutions in the embodiments of the present disclosure will be clearly and completely described below with reference to the drawings in the embodiments of the present disclosure. Obviously, the described embodiments are only a part of the embodiments of the present disclosure, but not all of the embodiments. Based on the embodiments in the present disclosure, all other embodiments obtained by a person having ordinary skill in the art without making creative efforts fall within the protection scope of the present disclosure.

The transistors used in all the embodiments of the present disclosure may be thin film transistors or field effect transistors or other devices with the same characteristics. In the embodiment of the present disclosure, in order to distinguish two electrodes of the transistor other than a control electrode, one of the electrodes is called a first electrode and the other electrode is called a second electrode.

In actual operation, the control electrode may be a base, the first electrode may be a collector, and the second electrode may be an emitter; or the control electrode may be a base, the first electrode may be an emitter, and the second electrode may be a collector.

In actual operation, when the transistor is a thin film transistor or a field effect transistor, the control electrode may be a gate electrode, the first electrode may be a drain electrode, and the second electrode may be a source electrode; or the control electrode may be a gate electrode, the first electrode may be a source electrode, and the second electrode may be a drain electrode.

Figure 1:
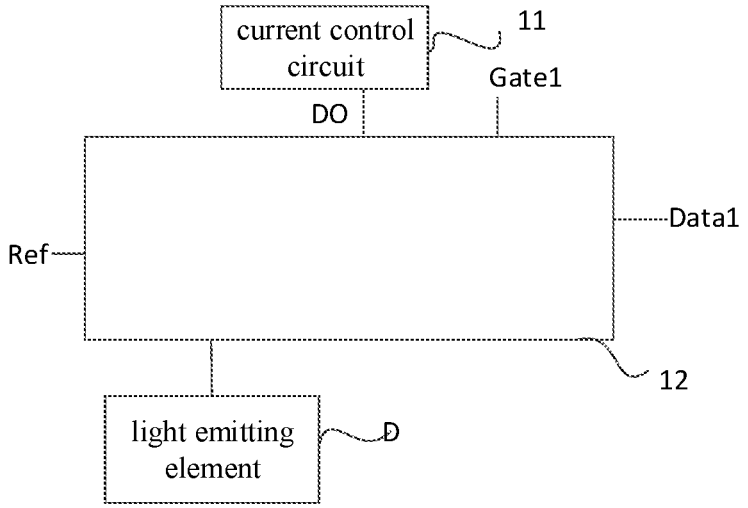
FIG. 1 is a schematic view of a pixel driving circuit according to one embodiment of the present disclosure.

As shown in FIG. 1, the pixel driving circuit according to the embodiment of the present disclosure includes a current control circuit 11 and a time control circuit 12, wherein the current control circuit 11 is configured to control and generate a driving current, and output the driving current through a driving current output terminal DO.

The time control circuit 12 includes a first data writing-in circuit 121 and a driving time control circuit 122.

The first data writing-in circuit 121 is electrically connected to a first gate line Gate1, a first data line Data1, and the driving time control circuit 122, respectively, and is configured to write a first data voltage provided by the first data line Data1 to the driving time control circuit 122 under the control of the first gate driving signal provided on the first gate line Gate1.

The driving time control circuit 122 is electrically connected to a reference voltage terminal Ref, the current control circuit 11, the first data writing-in circuit 121, and a light emitting element D, respectively, and is configured to control a time period during which the light emitting element D is driven to emit light by the driving current based on the reference voltage Vref and the first data voltage. The reference voltage terminal Ref is used to provide the reference voltage Vref.

In the embodiment of the present disclosure, the light emitting time period of the light emitting element D can be controlled by the driving time control circuit 122, and the light emitting time period is independent of Vf and Vth1. The problem of display unevenness caused by different threshold voltages of different light emitting elements and different threshold voltages of the first driving transistors in the display panel is solved, so as to improve display uniformity. Vf is a threshold voltage of the light emitting element D, and Vth1 is a threshold voltage of a first driving transistor included in the first driving circuit 22 in the driving time control circuit 122.

It can be understood that the light emitting element described in this solution may be a current-driven light emitting element, specifically, an inorganic light emitting diode of micrometer scale or an organic light emitting diode.

In specific implementation, the first electrode of the light emitting element D is electrically connected to the driving time control circuit 122, and the second electrode of the light emitting element D is electrically connected to the low voltage terminal or the ground terminal, but not limited thereto.

Figure 2:
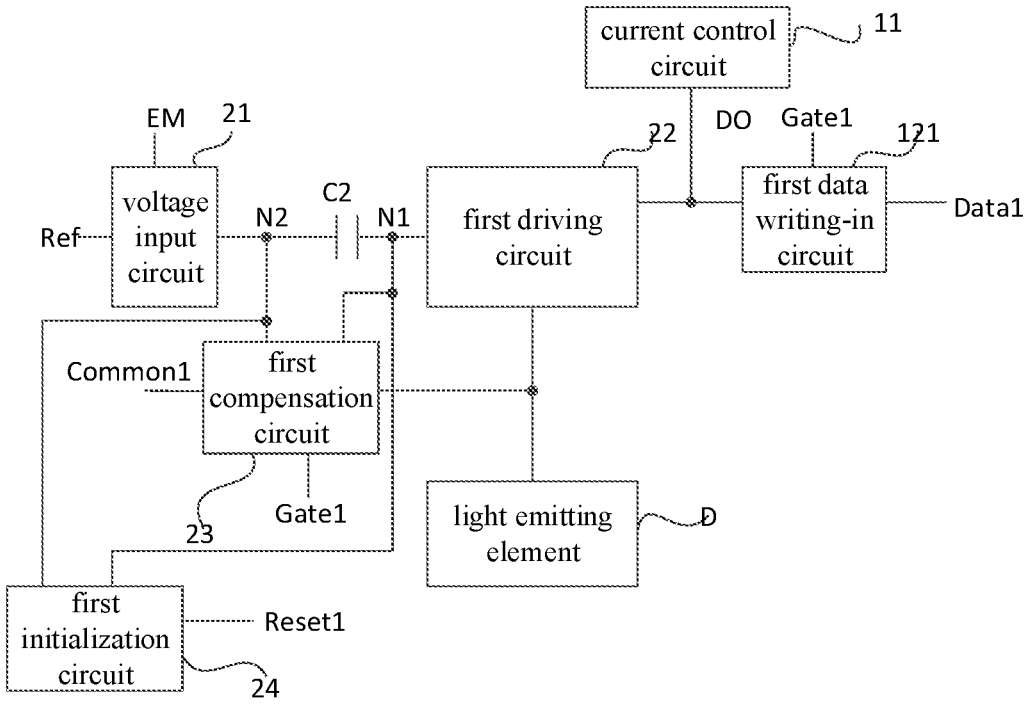
FIG. 2 is another schematic view of a pixel driving circuit according to one embodiment of the present disclosure.

In specific implementation, as shown in FIG. 2, based on the embodiment of the pixel driving circuit shown in FIG. 1, the driving time control circuit 122 may include a voltage input circuit 21, a first driving circuit 22, and a first compensation circuit 23, a first initialization circuit 24, and a time control capacitor C2.

The voltage input circuit 21 is electrically connected to a light emitting control line EM, the reference voltage terminal Ref, and the second terminal N2 of the time control capacitor C2, respectively. The reference voltage Vref is provided to the second terminal N2 of the time control capacitor C2 under the control of a light emitting signal provided by a light emitting control line EM; the reference voltage terminal Ref is used to provide the reference voltage Vref.

The control terminal of the first driving circuit 22 is electrically connected to the first terminal N1 of the time control capacitor C2, and the first terminal of the first driving circuit 22 is respectively connected to the driving current output terminal DO of the current control circuit 11 and the first data writing-in circuit 121, the second terminal of the first driving circuit 22 is electrically connected to the light emitting element D, and the first driving circuit 22 is used to control the connection of a first terminal of the first driving circuit 22 and a second terminal of the first driving circuit 22 under the control of the potential of the control terminal of the first driving circuit 22.

The first data writing-in circuit 121 is configured to write the first data voltage to a first terminal of the first driving circuit 22.

The first compensation circuit 23 is respectively connected to a first gate line Gate1, a control terminal of the first driving circuit 22, a second terminal of the first driving circuit 22, and a second terminal N2 of the time control capacitor C2 and a preset voltage terminal, and configured to control the connection of the control terminal of the first driving circuit 22 and the second terminal of a first driving circuit 22 under the control of a first gate driving signal provided by the first gate line Gate1, control to provide the preset voltage Common1 inputted by the preset voltage terminal to the first electrode of the light emitting element D, and control the connection of the second electrode of the light emitting element D and the second terminals N2 of the time control capacitor C2.

The first initialization circuit 24 is electrically connected to a first reset control line Reset1, a first terminal N1 of the time control capacitor C2, and a second terminal N2 of the second time control capacitor C2, respectively, and is configured to reset the potential of the first terminal N1 of the time control capacitor C2 and the potential of the second terminal N2 of the time control capacitor C2 under the control of the first reset control signal provided by the first reset control line Reset1.

The pixel driving circuit shown in FIG. 2 of the present disclosure is in operation.

In a first stage, the current control circuit 11 controls to write a second data voltage to a control terminal of a second driving circuit included in the current control circuit 11.

In a time reset phase, the first initialization circuit 24 controls to reset the potential of the first terminal N1 of the time control capacitor C2 and the potential of the second terminal N2 of the time control capacitor C2, to reset the potential of the first terminal N1 of C2 to the first time initialization voltage Vini_time1, so that at the beginning of a time charging phase, the first driving circuit 22 can control the connection of the first terminal and the second terminal of the first driving circuit 22 under the control of the potential of the control terminal of the first driving circuit 22. The first initialization circuit 24 also resets the potential of the second terminal N2 of C2 to the second time initialization voltage Vini_time2, so that at the beginning of the time charging phase, the light emitting element D can electrically connect the first electrode and the second electrode of D.

In a time charging phase, under the control of the first gate driving signal provided by the first gate line Gate1, the first data writing circuit 121 controls to write the first data voltage Vdata1 provided by the first data line Data1 to the first terminal of the first driving circuit 22, the first compensation circuit 23 controls the connection of the control terminal of the first driving circuit 22 and the second terminal of the first driving circuit 22, and controls to provide a preset voltage Common1 to the first electrode of the light emitting element D, and controls the connection of the second electrode of the light emitting element D and the second terminal N2 of the time control capacitor C2. At the beginning of the time charging phase, the light emitting element D controls to connect its first electrode and its second electrode, and charges the time control capacitor C2 through a preset voltage Common1 until the potential of the second terminal N2 of the time control capacitor C2 becomes Common1−Vf. The light emitting element D controls to disconnect the first electrode and the second electrode thereof, wherein Vf is a threshold voltage of the light emitting element D. The first driving circuit 22 controls to connect its first terminal and its second terminal, the compensation control voltage is used to charge the time control capacitor C2 through the first driving circuit 22 until the potential of N1 becomes Vdata1+Vth1; Vdata1 is a first data voltage.

In a light emitting phase, the current control circuit 11 controls and generates the driving current and outputs the driving current through the driving current output terminal based on the second data voltage Vdata2. The voltage input circuit 21 controls to provide the reference voltage Vref to the second terminal N2 of the time control capacitor C2 under the control of the light emitting control signal provided by the lighting control line EM. The reference voltage terminal Ref is used to provide the reference voltage Vref; at this time, the potential of the first terminal N1 of C2 jumps to Vdata1+Vref−Common1+Vf+Vth1, so that the light emitting time period of the light emitting element D is independent of Vf and Vth1; when T8 is turned on, the current control circuit 11 drives the light emitting element D to emit light.

In the light emitting stage, the gate voltage of the first driving transistor included in the first driving circuit 22 is equal to the potential of N1, and the source voltage of the first driving transistor is related to the threshold voltage Vf of D. When the difference between the gate-source voltage of the first driving transistor and Vth1 is less than 0, the first driving transistor is turned on, and an on-time of the first driving transistor is independent of Vth1 and Vf.

When the pixel driving circuit shown in FIG. 2 is in operation, in the light emitting phase, the reference voltage Vref is Vref0+K*t, where K is a positive number and Vref0 is the initial reference voltage provided by Ref at the beginning of the light emitting phase, t is a time difference between the time point in the light emitting phase and the start time of the light emitting phase. As the potential of N2 increases, the potential of N1 also increases until the gate-source voltage of the first driving transistor of the first driving circuit 22 is increased to enable the first driving transistor to be turned off, the light emitting element D is changed from emitting light to no emitting light. Therefore, the light emitting time period of the light emitting element D can be controlled by Vdata1 and Vref.

In specific implementation, the first phase may include a current reset phase and a current charging phase. When the pixel driving circuit shown in FIG. 2 of the present disclosure is in operation, in the current reset phase, the potential of the control terminal of the second driving circuit in the current control circuit 11 is reset; and in the current charging phase, the second data voltage Vdata2 on the second data line is written into the first terminal of the second driving circuit, and the threshold voltage Vth2 of the second driving transistor included in the second driving circuit is compensated, so that the potential of the control terminal of the second driving circuit is Vdata2+Vth2.

In the embodiment of the present disclosure, the first driving transistor may be a p-type transistor, but is not limited thereto. In actual operation, the first driving transistor may also be an n-type transistor. In this case, K is a negative number.

In specific implementation, the first data writing-in circuit may include a first data writing-in transistor, a control electrode thereof being electrically connected to a first gate line, a first electrode thereof being electrically connected to the first data line, and a second electrode thereof being electrically connected to the driving time control circuit.

Optionally, the driving time control circuit further includes a first light emitting control circuit. The first light emitting control circuit is configured to control the connection of the second terminal of the first driving circuit and the first electrode of the light emitting element under the control of a light emitting control signal provided by a light emitting control line, and control the connection of the second electrode of the light emitting element and the first voltage terminal.

Figure 3:
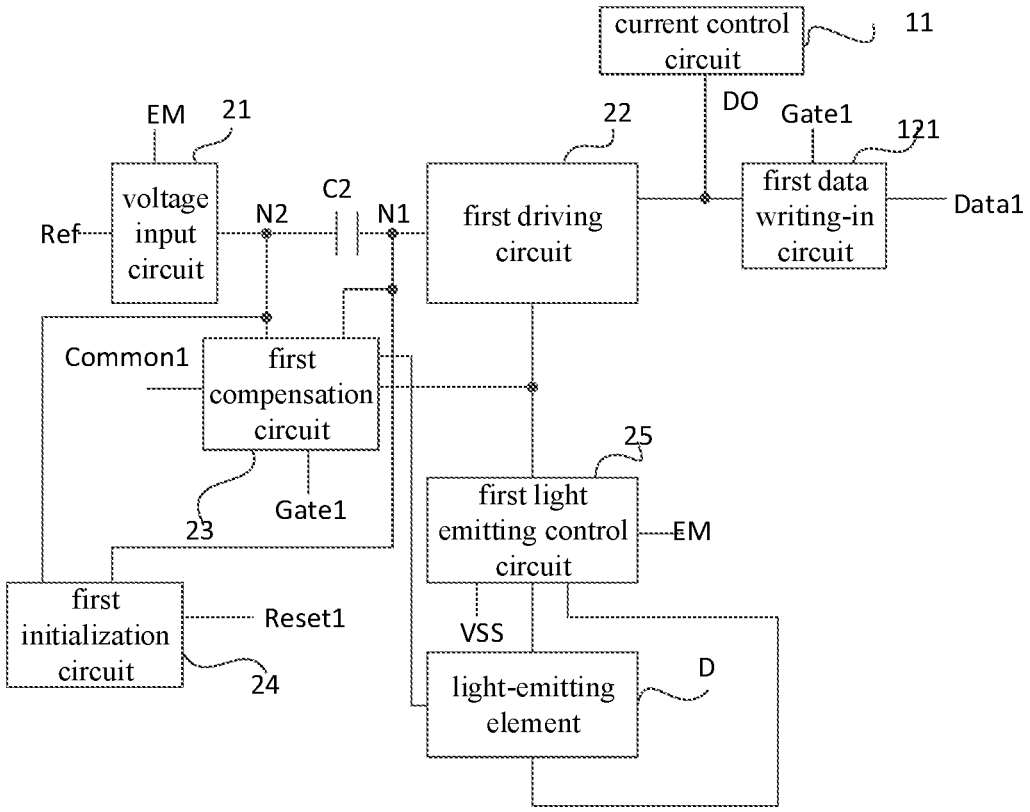
FIG. 3 is yet another schematic view of a pixel driving circuit according to one embodiment of the present disclosure.

As shown in FIG. 3, based on the pixel driving circuit shown in FIG. 2, the driving time control circuit further includes a first light emitting control circuit 25. The first light emitting control circuit 25 is respectively connected to a light emitting control line EM, a second terminal of the first driving circuit 22, a first electrode of the light emitting element D, a second electrode of the light emitting element D, and a first voltage, and configured to control the connection of the second terminal of the first driving circuit 22 and the first electrode of the light emitting element D under the control of the light emitting control signal provided by the light emitting control line EM, and control the connection of the second electrode of the light emitting element D and the first voltage terminal VT1.

When the pixel driving circuit shown in FIG. 3 in the present disclosure is in operation, in the light emitting phase, the first light emitting control circuit 25 controls the connection of the second terminal of the first driving circuit 22 and the first electrode of the light emitting element D under the control of the light emitting control signal provided by the light emitting control line EM, and controls the connection of the second electrode of the light emitting element D and the first voltage terminal VT1.

In specific implementation, the first voltage terminal VT1 may be a low voltage terminal VSS or a ground terminal, but is not limited thereto.

Specifically, the voltage input circuit may include a voltage input transistor. A control electrode of the voltage input transistor is electrically connected to the light emitting control line, a first electrode of the voltage input transistor is electrically connected to a reference voltage terminal, and a second electrode of the voltage input transistor is connected to a first electrode of the time control capacitor.

Specifically, the first driving circuit may include a first driving transistor.

A control electrode of the first driving transistor is electrically connected to a first terminal of the time control capacitor, and a first electrode of the first driving transistor is respectively connected to a driving current output terminal of the current control circuit and the first data writing-in circuit, and the second electrode of the first driving transistor is electrically connected to the light emitting element.

In specific implementation, the first compensation circuit may include a first compensation transistor, a second compensation transistor, and a third compensation transistor. A control electrode of the first compensation transistor is electrically connected to the first gate line, a first electrode of the first compensation transistor is electrically connected to a control terminal of the first driving circuit, and a second electrode of the first compensation transistor is electrically connected to the second terminal of the first driving circuit. A control electrode of the second compensation transistor is electrically connected to the first gate line, a first electrode of the second compensation transistor is electrically connected to a preset voltage terminal, and a second electrode of the second compensation transistor is connected to the first electrode of the light emitting element. A control electrode of the third compensation transistor is electrically connected to the first gate line, a first electrode of the third compensation transistor is electrically connected to a second electrode of the light emitting element, and a second electrode of the third compensation transistor is electrically connected to the second terminal of the time control capacitor.

Specifically, the first initialization circuit may include a first initialization transistor and a second initialization transistor. A control electrode of the first initialization transistor is electrically connected to the first reset control line, a first electrode of the first initialization transistor is electrically connected to a first terminal of the time control capacitor, and a second electrode of the first initialization transistor is electrically connected to the first initialization voltage terminal. A control electrode of the second initialization transistor is electrically connected to the first reset control line, a first electrode of the second initialization transistor is electrically connected to the second terminal of the time control capacitor, and a second electrode of the second initialization transistor is electrically connected to the second initialization voltage terminal.

Specifically, the first light emitting control circuit may include a first light emitting control transistor and a second light emitting control transistor. A control electrode of the first light emitting control transistor is electrically connected to the light emitting control line, a first electrode of the first light emitting control transistor is electrically connected to a second terminal of the first driving circuit, and the second electrode of the first light emitting control transistor is electrically connected to the first electrode of the light emitting element. A control electrode of the second light emitting control transistor is electrically connected to the light emitting control line, a first electrode of the second light emitting control transistor is electrically connected to a second electrode of the light emitting element, and a second electrode of the second light emitting control transistor is electrically connected to the first voltage terminal.

Figure 4:
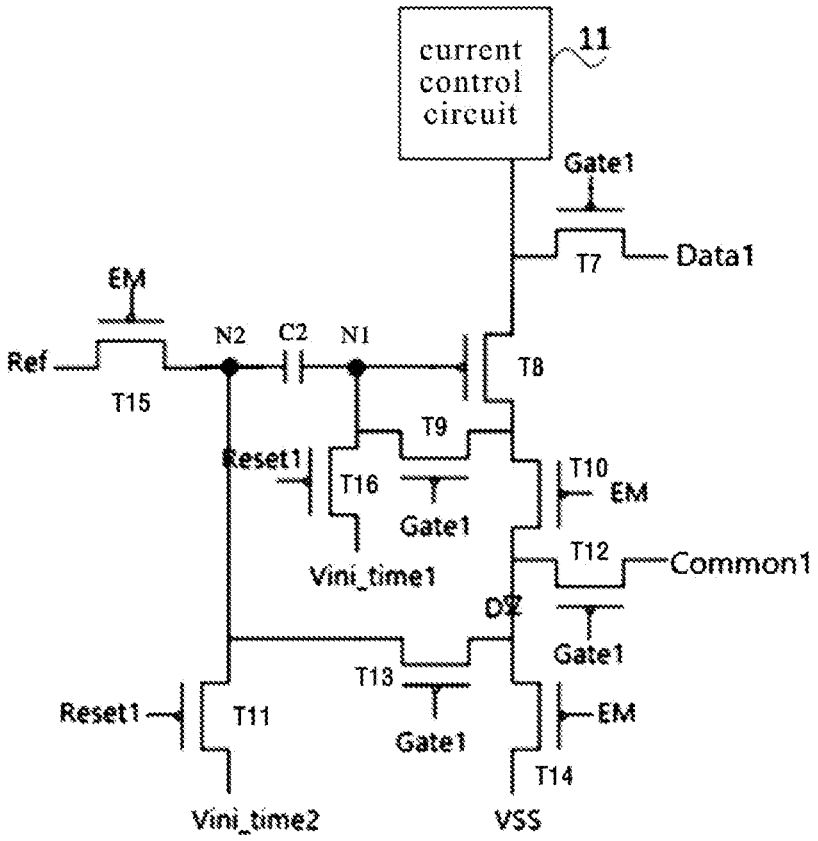
FIG. 4 is a schematic view of a pixel driving circuit according to one embodiment of the present disclosure.

As shown in FIG. 4, on the basis of the embodiment of the pixel driving circuit shown in FIG. 3, in a first specific embodiment of the pixel driving circuit according to the present disclosure, the light emitting element is a light emitting diode D. The voltage input circuit includes a voltage input transistor T15; the first data writing-in circuit includes a first data writing-in transistor T7; the first driving circuit includes a first driving transistor T8; the first light emitting control circuit includes a first light emitting control transistor T10 and the second light emitting control transistor T14.

A gate electrode of the first data writing-in transistor T7 is electrically connected to a first gate line Gate1, a source electrode of the first data writing-in transistor T7 is electrically connected to a first data line Data1, and a drain electrode of the first data writing transistor T7 is electrically connected to a source electrode of the first driving transistor T8.

A gate electrode of the voltage input transistor T15 is electrically connected to the light emitting control line EM, a source electrode of the voltage input transistor T15 is electrically connected to the reference voltage terminal Ref, and a drain electrode of the voltage input transistor T15 is connected to a second terminal N2 of the time control capacitor C2.

A gate electrode of the first driving transistor T8 is electrically connected to the first terminal N1 of the time control capacitor C2, and a source electrode of the first driving transistor T8 is electrically connected to the driving current output terminal of the current control circuit 11, a drain electrode of the first driving transistor T8 is electrically connected to a source electrode of the first light emitting control transistor T10.

A gate electrode of the first light emitting control transistor T10 is electrically connected to the light emitting control line EM, and a drain electrode of the first light emitting control transistor T10 is electrically connected to the first electrode of the light emitting diode D.

A gate electrode of the second light emitting control transistor T14 is electrically connected to the light emitting control line EM, and a source electrode of the second light emitting control transistor T14 is electrically connected to the second electrode of the light emitting diode D, and a drain electrode of the second light emitting control transistor T14 is electrically connected to a low voltage terminal, which is used to provide a low voltage VSS.

The first compensation circuit includes a first compensation transistor T9, a second compensation transistor T12, and a third compensation transistor T13.

A gate electrode of the first compensation transistor T9 is electrically connected to the first gate line Gate1, a source electrode of the first compensation transistor T9 is electrically connected to a gate electrode of the first driving transistor T8, and a drain electrode of the first compensation transistor T9 is electrically connected to a drain electrode of the first driving transistor T8.

A gate electrode of the second compensation transistor T12 is electrically connected to the first gate line Gate1, a source electrode of the second compensation transistor T12 is electrically connected to a preset voltage terminal, and a drain electrode of the second compensation transistor T12 is connected to the first electrode of the light emitting diode D, the preset voltage terminal is used to provide a preset voltage Common1.

A gate electrode of the third compensation transistor T13 is electrically connected to the first gate line Gate1, a source electrode of the third compensation transistor T13 is electrically connected to a second electrode of the light emitting diode D, and a drain electrode of the third compensation transistor T13 is electrically connected to the second terminal of the time control capacitor C2.

The first initialization circuit includes a first initialization transistor T11 and a second initialization transistor T16.

A gate electrode of the first initialization transistor T16 is electrically connected to the first reset control line Reset1, and a source electrode of the first initialization transistor T16 is electrically connected to the first terminal N1 of the time control capacitor C2, a drain electrode of the first initialization transistor T16 is electrically connected to a first initialization voltage terminal; the first initialization voltage terminal is used to provide a first initialization voltage Vini_time1.

A gate electrode of the second initialization transistor T11 is electrically connected to the first reset control line Reset1, and a source electrode of the second initialization transistor T11 is electrically connected to the second terminal N2 of the time control capacitor C2, a drain electrode of the second initialization transistor T11 is electrically connected to a second initialization voltage terminal; the second initialization voltage terminal is used to provide a second initialization voltage Vini_time2.

The first light emitting control circuit includes a first light emitting control transistor T10 and a second light emitting control transistor T14.

A gate electrode of the first light emitting control transistor T10 is electrically connected to the light emitting control line EM, a source electrode of the first light emitting control transistor T10 is electrically connected to a drain electrode of the first driving transistor T8, and a drain electrode of the first light emitting control transistor T10 is electrically connected to the first electrode of the light emitting diode D.

A gate electrode of the second light emitting control transistor T14 is electrically connected to the light emitting control line EM, a source electrode of the second light emitting control transistor T14 is electrically connected to a second electrode of the light emitting diode, and a drain electrode of the second light emitting control transistor T14 is connected to the low voltage VSS.

In the first specific embodiment of the pixel driving circuit shown in FIG. 4, all the transistors are p-type thin film transistors, but not limited thereto.

The first specific embodiment of the pixel driving circuit shown in FIG. 4 of the present disclosure is in operation.

In the current reset stage, the potential of the control terminal of the second driving circuit in the current control circuit 11 is reset.

In the current charging phase, the second data voltage Vdata2 on the second data line is written into the first terminal of the second driving circuit, and the threshold voltage Vth2 of the second driving transistor included in the second driving circuit is compensated, so that the potential of the control terminal of the second driving circuit is Vdata2+Vth2.

In the time reset phase, EM inputs a high level, Reset1 inputs a low level, Gate1 inputs a high level, T11 and T16 are turned on to reset the potential of N1 to Vini_time1, so that at the beginning of the time charging phase, the first driving transistor T8 can be turned on, and the potential of N2 can be reset to the second time initialization voltage Vini_time2, so that at the beginning of the time charging phase, D can be turned on.

In the time charging phase, EM inputs a high level, Reset1 inputs a high level, and Gate1 inputs a low level. T7, T9, T12, and T13 are all turned on to write the first data voltage Vdata1 provided by the first data line Data1 to the source electrode of the first driving transistor T8, the gate electrode of T8 is connected to the drain electrode of T8, and the second electrode of D is connected to the second terminal N2 of C2, and a preset voltage Common1 is provided to the first electrode of D, so that D is in the on state, and C2 is charged through the preset voltage Common1 until the potential of the second terminal N2 of C2 becomes Common1−Vf, and D is in the off state; and T8 is turned on to charge C2 through Vdata1, so as to increase the potential of N1 until the potential of N1 becomes Vdata1+Vth1, where Vth1 is the threshold voltage of T8.

In the light emitting phase, Reset1 inputs a high level, Gate1 inputs a high level, EM inputs a low level, T15, T10 and T14 are turned on, the potential of N2 becomes Vref, and the potential of N1 jumps to Vdata1+Vref−Common1+Vf+Vth1, the light emitting time of D may be controlled through Vref and Vdata1.

In the light emitting phase, the gate voltage of the first driving transistor T8 is equal to the potential of N1. The source voltage of the first driving transistor T8 is related to the threshold voltage Vf of D. When the difference between the gate-source voltage of the first driving transistor T8 and Vth1 is less than 0, T8 is turned on, and the on-time of T8 is independent of Vth1 and Vf.

When the pixel driving circuit shown in FIG. 4 according to the embodiment of the present disclosure is in operation, in the light emitting phase, the reference voltage Vref is Vref0+K*t, where K is a positive number and Vref0 is the initial reference voltage provided by Ref at the beginning of the light emitting phase, t is the time difference between the time point in the light emitting phase and the start time of the light emitting phase. As the potential of N2 increases, the potential of N1 also increases until the gate-source voltage of the first driving transistor in the first driving circuit 22 increases to enable the first driving transistor to be turned off, the light emitting element D changes from emitting light to not emitting light, so the light emitting time period of the light emitting element D can be controlled by controlling Vdata1 and Vref.

In specific implementation, the current control circuit may include a second driving circuit, a second data writing-in circuit, a current control capacitor, a second light emitting control circuit, a second initialization circuit, and a second compensation circuit. The first terminal of the current control capacitor is electrically connected to the power voltage terminal.

The second light emitting control circuit is used to control the connection of the first terminal of the second driving circuit and the first terminal of the current control capacitor under the control of the light emitting control signal inputted by the light emitting control line, and control the connection of the second terminal of the second driving circuit and the driving current output terminal. A second terminal of the current control capacitor is electrically connected to a control terminal of the second driving circuit.

The second driving circuit is used to control the connection of the first terminal of the second driving circuit and the second terminal of the second driving circuit under the control of the potential of the control terminal of the second driving circuit.

The second data writing-in circuit is used to control the connection of the second data line and the first terminal of the second driving circuit under the control of the second gate driving signal provided by the second gate line.

The second compensation circuit is configured to control the connection of the control terminal of the second driving circuit and the second terminal of the second driving circuit under the control of the second gate driving signal.

The second initialization circuit is configured to control the connection of the third initialization voltage terminal and the control terminal of the second driving circuit under the control of the second reset control signal provided by the second reset control line.

Figure 5:
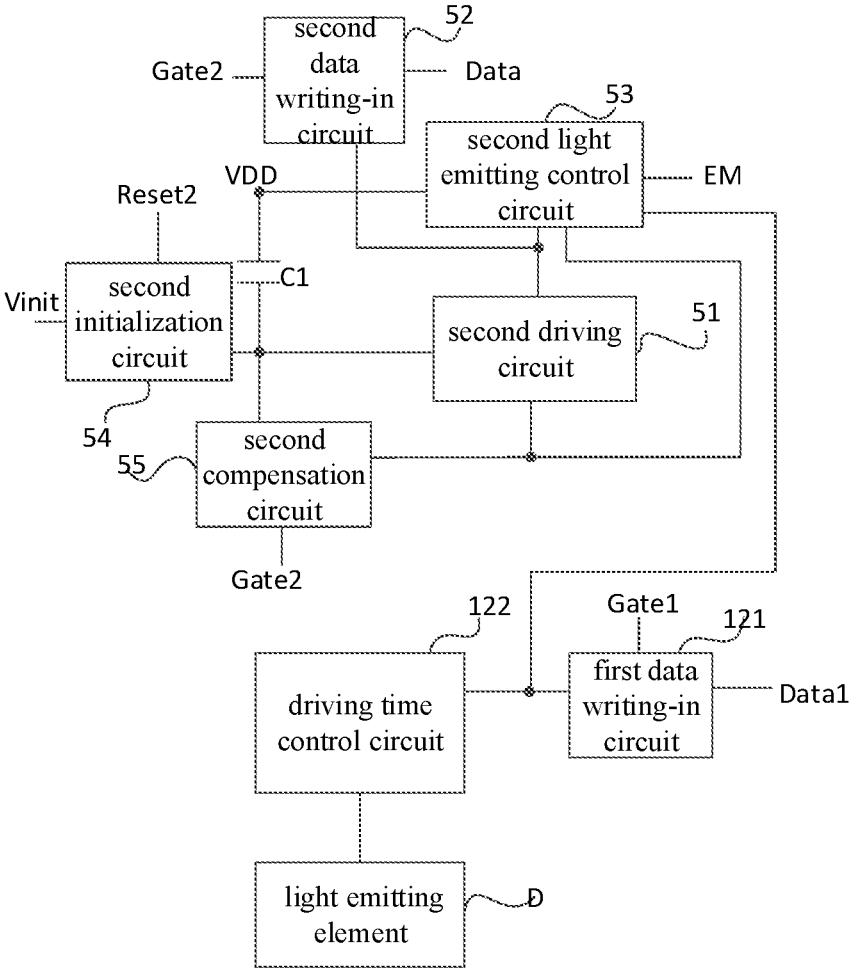
FIG. 5 is yet another schematic view of a pixel driving circuit according to one embodiment of the present disclosure.

As shown in FIG. 5, based on the embodiment of the pixel driving circuit shown in FIG. 1, the current control circuit includes a second driving circuit 51, a second data writing-in circuit 52, a current control capacitor C1, and a second light emitting control circuit 53, the second initialization circuit 54, and the second compensation circuit 55; the first terminal of C1 is connected to the high voltage VDD.

The second light emitting control circuit 53 is connected to the light emitting control line EM, the first terminal of the second driving circuit 51, the first terminal of the current control capacitor C1, the second terminal of the second driving circuit 51, and the driving current output terminal, and configured to control the connection of the first terminal of the second driving circuit 51 and the first terminal of the current control capacitor C1 under the control of the light emitting control signal inputted by the light emitting control line EM, and control the connection of the second terminal of the second driving circuit 51 and the driving current output terminal; the driving current output terminal is electrically connected to the driving time control circuit 122.

A first terminal of the current control capacitor C1 is electrically connected to a power supply voltage terminal, and a second terminal of the current control capacitor C1 is electrically connected to a control terminal of the second driving circuit 51; the power supply voltage terminal is used to provide a high voltage VDD.

The second driving circuit 51 is configured to control the connection of the first terminal of the second driving circuit 51 and the second terminal of the second driving circuit 51 under the control of the potential of the control terminal of the second driving circuit 51.

The second data writing-in circuit 52 is electrically connected to the second gate line Gate2, the second data line Data2, and the first terminal of the second driving circuit 51, respectively, and configured to control the connection of the second data line Data2 and the first terminal of the second driving circuit 51 under the control of the second gate driving signal provided by the second gate line Gate2.

The second compensation circuit 55 is electrically connected to the second gate line Gate2, the control terminal of the second driving circuit 51, and the second terminal of the second driving circuit 51, respectively, and is configured to control the connection of the control terminal of the second driving circuit 51 and the second terminal of the second driving circuit 52 under the control of the second gate driving signal.

The second initialization circuit 54 is electrically connected to the second reset control line Reset2, the third initialization voltage terminal, and the control terminal of the second driving circuit 51, respectively, and is configured to control the connection of the third initialization voltage terminal and the control terminal of the second driving circuit 51 under the control of the second reset control signal provided by the second reset control line Reset2. The third initialization voltage terminal is used to provide a third initialization voltage Vinit.

The pixel driving circuit shown in FIG. 5 of the present disclosure is in operation.

In the current reset phase, the second initialization circuit 54 controls to reset the potential of the control terminal of the second driving circuit 51 under the control of a second reset control signal, so that at the beginning of the current charging phase, the second driving circuit 51 is capable of connecting its first terminal and its second terminal.

In the current charging phase, the second data writing-in circuit 52 controls the connection of the second data line Data2 and the first terminal of the second driving circuit 51 under the control of the second gate driving signal provided by the second gate line Gate2, so as to write the second data voltage Vdata2 on the second data line Data2 to the first terminal of the second driving circuit 51. The second driving circuit 51 connects the first terminal and the second terminal thereof. The second compensation circuit 55 controls the connection of the control terminal of the second driving circuit 51 and the second terminal of the second driving circuit 52. C1 is charged through Vdata2 to increase the potential of the control terminal of the second driving circuit 51 until the second driving circuit 51 disconnects the first terminal and the second terminal thereof. At this time, the potential of the control terminal of the second driving circuit 51 is Vdata2+Vth2, and Vth2 is the threshold voltage of the second driving transistor in the second driving circuit 51.

Specifically, the second driving circuit may include a second driving transistor. A control electrode of the second driving transistor is a control terminal of the second driving circuit, a first electrode of the second driving transistor is a first terminal of the second driving circuit, and a second electrode of the second driving transistor is the second terminal of the second driving circuit.

The second data writing-in circuit includes a second data writing-in transistor. A control electrode of the second data writing-in transistor is electrically connected to the second gate line, a first electrode of the second data writing-in transistor is electrically connected to the second data line, and the second electrode of the second data writing-in transistor is electrically connected to the first electrode of the second driving transistor.

The second compensation circuit includes a fourth compensation transistor. A control electrode of the fourth compensation transistor is electrically connected to the second gate line, a first electrode of the fourth compensation transistor is electrically connected to a control terminal of the second driving circuit, and a second electrode of the fourth compensation transistor is electrically connected to the second terminal of the second driving circuit.

The second light emitting control circuit includes a third light emitting control transistor and a fourth light emitting control transistor; A control electrode of the third light emitting control transistor is electrically connected to the light emitting control line, a first electrode of the third light emitting control transistor is electrically connected to a first terminal of the second driving circuit, and the second electrode of the third light emitting control transistor is electrically connected to the first terminal of the current control capacitor. A control electrode of the fourth light emitting control transistor is electrically connected to the light emitting control line, a first electrode of the fourth light emitting control transistor is electrically connected to a second terminal of the second driving circuit, and the second electrode of the fourth light emitting control transistor is electrically connected to the driving current output terminal.

In specific implementation, the second initialization circuit may include a third initialization transistor. A control electrode of the third initialization transistor is electrically connected to the second reset control line, a first electrode of the third initialization transistor is electrically connected to a second initialization voltage terminal, and a second electrode of the third initialization transistor is connected to the control terminal of the second driving circuit.

Figure 6:
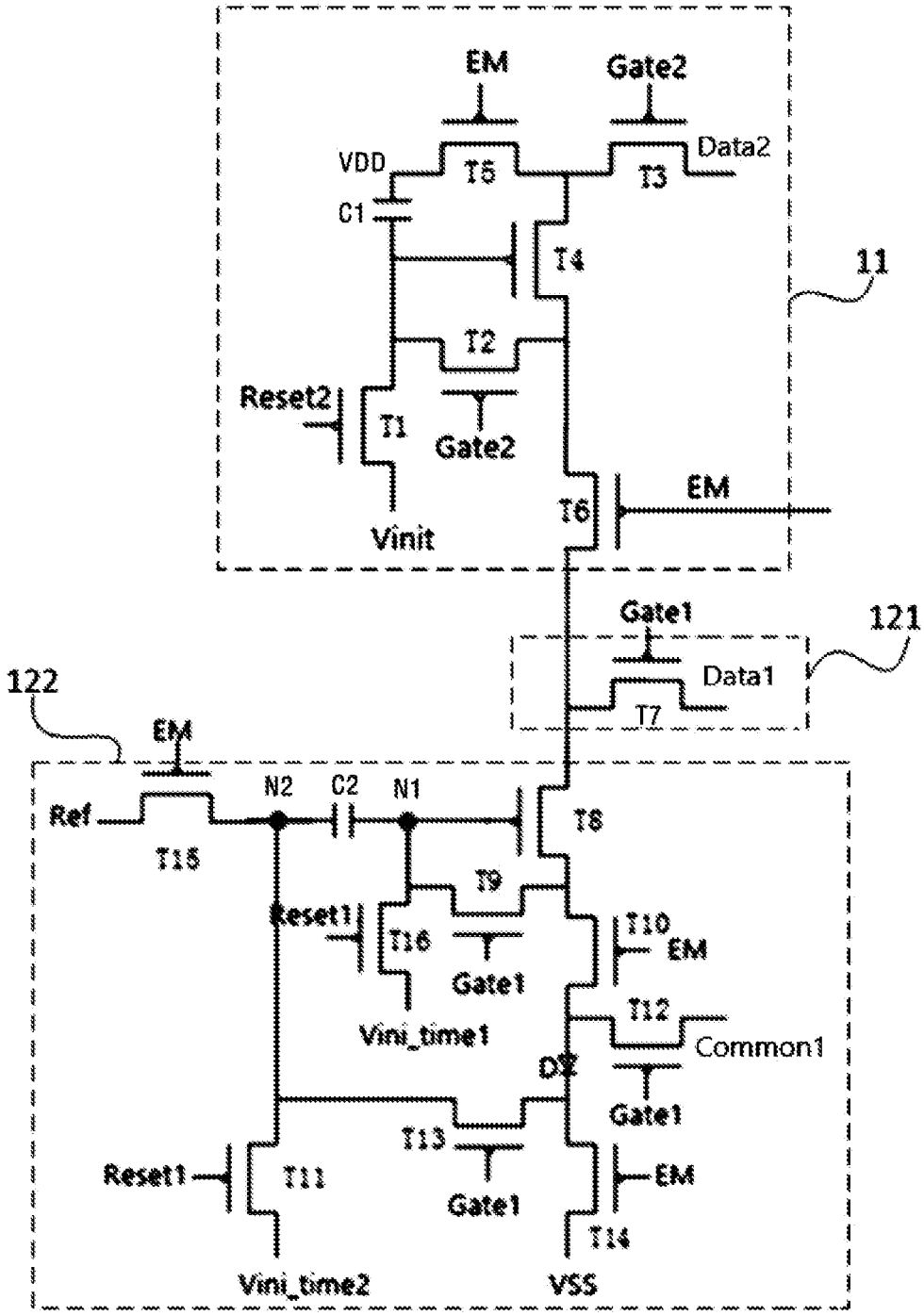
FIG. 6 is a schematic view of a pixel driving circuit according to another embodiment of the present disclosure.

As shown in FIG. 6, the second specific embodiment of the pixel driving circuit according to the present disclosure includes a current control circuit 11 and a time control circuit. The time control circuit includes a first data writing-in circuit 121 and a driving time control circuit 122. The light emitting element is a light emitting diode D.

The driving time control circuit 122 may include a voltage input circuit, a first driving circuit, a first compensation circuit, a first initialization circuit, and a time control capacitor C2. The first data writing-in circuit 121 includes a first data writing transistor T7.

The voltage input circuit includes a voltage input transistor T15; the first driving circuit includes a first driving transistor T8; the first light emitting control circuit includes a first light emitting control transistor T10 and a second light emitting control transistor T14.

A gate electrode of the first data writing-in transistor T7 is electrically connected to a first gate line Gate1, a source electrode of the first data writing-in transistor T7 is electrically connected to a first data line Data1, and a drain electrode of the first data writing-in transistor T7 is electrically connected to the source electrode of the first driving transistor T8.

A gate electrode of the voltage input transistor T15 is electrically connected to the EM light emitting control line, a source electrode of the voltage input transistor T15 is electrically connected to the reference voltage terminal Ref, and a drain electrode of the voltage input transistor T15 is connected to the second terminal N2 of the time control capacitor C2.

A gate electrode of the first driving transistor T8 is electrically connected to the first terminal N1 of the time control capacitor C2, and a source electrode of the first driving transistor T8 is electrically connected to the driving current output terminal of the current control circuit 11, a drain electrode of the first driving transistor T8 is electrically connected to a source electrode of the first light emitting control transistor T10.

A gate electrode of the first light emitting control transistor T10 is electrically connected to the light emitting control line EM, and a drain electrode of the first light emitting control transistor T10 is electrically connected to the first electrode of the light emitting diode D.

A gate electrode of the second light emitting control transistor T14 is electrically connected to the light emitting control line EM, and a source electrode of the second light emitting control transistor T14 is electrically connected to the second electrode of the light emitting diode D, a drain electrode of the second light emitting control transistor T14 is electrically connected to a low voltage terminal, which is used to provide a low voltage VSS.

The first compensation circuit includes a first compensation transistor T9, a second compensation transistor T12, and a third compensation transistor T13.

A gate electrode of the first compensation transistor T9 is electrically connected to the first gate line Gate1, a source electrode of the first compensation transistor T9 is electrically connected to a gate electrode of the first drive transistor T8, and a drain electrode of the first compensation transistor T9 is electrically connected to a drain electrode of the first driving transistor T8. A gate electrode of the second compensation transistor T12 is electrically connected to the first gate line Gate1, a source electrode of the second compensation transistor T12 is electrically connected to a preset voltage terminal, and a drain electrode of the second compensation transistor T12 is connected to the first electrode of the light emitting diode D; the preset voltage terminal is used to provide a preset voltage Common1. A gate electrode of the third compensation transistor T13 is electrically connected to the first gate line Gate1, a source electrode of the third compensation transistor T13 is electrically connected to a second electrode of the light emitting diode D, and a drain electrode of the third compensation transistor T13 is electrically connected to the second terminal of the time control capacitor C2.

The first initialization circuit includes a first initialization transistor T11 and a second initialization transistor T16. A gate electrode of the first initialization transistor T11 is electrically connected to the first reset control line Reset1, and a source electrode of the first initialization transistor T11 is electrically connected to the first terminal N1 of the time control capacitor C2, and a drain electrode of an initialization transistor T11 is electrically connected to a first initialization voltage terminal; the first initialization voltage terminal is used to provide a first initialization voltage Vini_time1. A gate electrode of the second initialization transistor T16 is electrically connected to the first reset control line Reset1, and a source electrode of the second initialization transistor T16 is electrically connected to the second terminal N2 of the time control capacitor C2, and a drain electrode of the second initialization transistors T16 is electrically connected to a second initialization voltage terminal; the second initialization voltage terminal is used to provide a second initialization voltage Vini_time2.

The first light emitting control circuit includes a first light emitting control transistor T10 and a second light emitting control transistor T14. A gate electrode of the first light emitting control transistor T10 is electrically connected to the light emitting control line EM, a source electrode of the first light emitting control transistor T10 is electrically connected to a drain electrode of the first drive transistor T8, and a drain electrode of the first light emitting control transistor T10 is electrically connected to the first electrode of the light emitting diode D. A gate electrode of the second light emitting control transistor T16 is electrically connected to the light emitting control line EM, a source electrode of the second light emitting control transistor T16 is electrically connected to a second electrode of the light emitting diode, and a drain electrode of the second light emitting control transistor T16 is connected to a low voltage VSS.

The current control circuit 11 includes a second driving circuit, a second data writing-in circuit, a current control capacitor C1, a second light emitting control circuit, a second initialization circuit, and a second compensation circuit; a first terminal of C1 is connected to a high voltage VDD.

The second driving circuit includes a second driving transistor T4.

The second data writing-in circuit includes a second data writing-in transistor T3. A gate electrode of the second data writing-in transistor T3 is electrically connected to the second gate line Gate2, a source electrode of the second data writing-in transistor T3 is electrically connected to the second data line Data2, and a drain of the second data writing-in transistor T3 is electrically connected to a source electrode of the second driving transistor T4.

The second compensation circuit includes a fourth compensation transistor T2. A gate electrode of the fourth compensation transistor T2 is electrically connected to the second gate line Gate2, a source electrode of the fourth compensation transistor T2 is electrically connected to a gate electrode of the second driving transistor T4, and a drain electrode of the fourth compensation the transistor T2 is electrically connected to the drain electrode of the second driving transistor T4.

The second light emitting control circuit includes a third light emitting control transistor T5 and a fourth light emitting control transistor T6. A gate electrode of the third light emitting control transistor T5 is electrically connected to the light emitting control line EM, a source electrode of the third light emitting control transistor T5 is electrically connected to a source electrode of the second driving transistor T4, and a drain electrode of the third light emitting control transistor T5 is electrically connected to the first terminal of the current control capacitor C1. A gate electrode of the fourth emitting control transistor T6 is electrically connected to the emitting control line EM, a source electrode of the fourth emitting control transistor T6 is electrically connected to a drain electrode of the second drive transistor T4, and a drain electrode of the fourth light emitting control transistor T6 is electrically connected to the source electrode of T8.

The second initialization circuit includes a third initialization transistor T1. A gate electrode of the third initialization transistor T1 is electrically connected to the second reset control line Reset2, a source electrode of the third initialization transistor T1 is electrically connected to a third initialization voltage terminal, and a drain electrode of the third initialization transistor T1 is electrically connected to the gate electrode of T4; the third initialization voltage terminal is used to provide a third initialization voltage Vinit.

In the second specific embodiment of the pixel driving circuit shown in FIG. 6, all the transistors are p-type transistors, but not limited thereto.

When the pixel driving circuit shown in FIG. 6 is in operation, T4 is used to control the driving current for driving D, and in the light emitting phase, T4 is in a saturated state; T8 is used to control the light emitting time period of D. In the light emitting phase, T8 is turned on or off.

Figure 7:
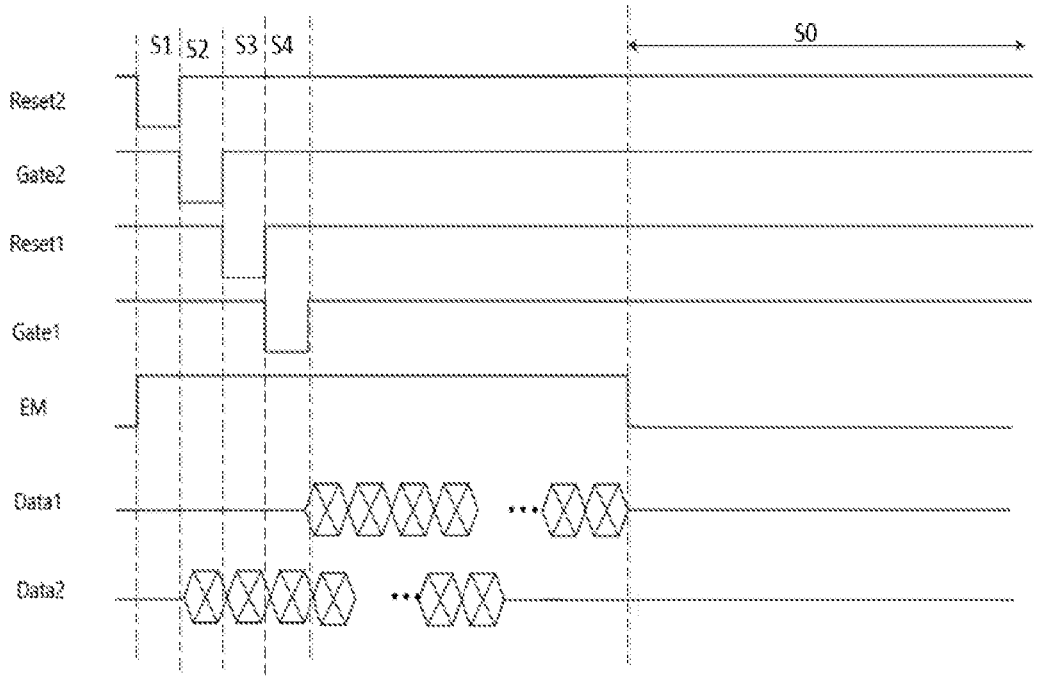
FIG. 7 is a time sequence diagram of the pixel driving circuit according to the second embodiment of the present disclosure.

As shown in FIG. 7, the pixel driving circuit according to the present disclosure is in operation.

In the current reset phase S1, Reset2 inputs a low level, EM, Gate2, Gate1 and Reset1 all input a high level, T1 is turned on to reset the potential of the gate electrode of T4 to Vinit, so that at the beginning of the current charging phase S2, T4 is turned on.

In the current charging phase S2, Gate2 inputs a low level, EM, Reset2, Gate1 and Reset1 all input a high level, T3 and T2 are turned on, Data2 inputs the second data voltage Vdata2, Vdata2 is written to the source electrode of T4, and the gate electrode of T4 is connected to the drain electrode of T4. T4 is turned on to charge C1 through Vdata2 until the gate voltage of T4 becomes Vdata2+Vth2, T4 is turned off, and Vth2 is the threshold voltage of T4.

In the time reset phase S3, EM, Gate2 and Reset2 all input a high level, Reset1 inputs a low level, Gate1 inputs a high level, T11 and T16 are turned on to reset the potential of N1 to Vini_time1, so that at the beginning of the time charging phase S4, the first driving transistor T8 can be turned on, and the potential of N2 is reset to the second time initialization voltage Vini_time2, so that at the beginning of the time charging phase S4, D can be turned on.

In the time charging phase S4, EM, Gate2 and Reset2 all input a high level, Reset1 inputs a high level, Gate1 inputs a low level, T7, T9, T12 and T13 are all turned on, the first data line Data1 provides the first data voltage Vdata1, so as to write Vdata1 to the source electrode of the first driving transistor T8, the gate electrode of T8 is connected to the drain electrode of T8, and the second electrode of D is connected to the second terminal N2 of C2, so as to provide a preset voltage Common1 to the first electrode of D, and D is in an on state. C2 is charged by a preset voltage Common1 until the potential of the second terminal N2 of C2 becomes Common1−Vf, and D is in an off state; and T8 is turned on, C2 is charged through Vdata1 to increase the potential of N1 until the potential of N1 becomes Vdata1+Vth1, where Vth1 is the threshold voltage of T8.

In the light emitting phase S0, EM, Gate2, and Reset2 all input a high level, Reset1 inputs a high level, Gate1 inputs a high level, EM inputs a low level, T15, T10, and T14 are turned on, and the potential of N2 becomes Vref, then the potential of N1 jumps to Vdata1+Vref−Common1+Vf+Vth1. The light emitting time period of D can be controlled through Vref and Vdata1.

In the light emitting phase S0, the gate voltage of the first driving transistor T8 is equal to the potential of N1. The source voltage of the first driving transistor T8 is related to the threshold voltage Vf of D. When the difference between the gate-source voltage of the first driving transistor T8 and Vth1 is less than 0, T8 is turned on, and the on-time of T8 is independent of Vth1 and Vf.

When the pixel driving circuit shown in FIG. 6 according to the embodiment of the present disclosure is in operation, the light emitting element D emits light at the beginning of the light emitting phase. In the light emitting phase, the reference voltage Vref is Vref0+K*t, where K is a positive number, Vref0 is the initial reference voltage provided by Ref at the beginning of the light emitting phase, and t is a time difference between the time point in the light emitting phase and the start time of the light emitting phase, as the potential of N2 increases, the potential of N1 also increases until the gate-source voltage of the first driving transistor in the first driving circuit 22 increases to enable the first driving transistor to be turned off, the light emitting element D changes from emitting light to not emitting light. Therefore, by controlling Vdata1 and Vref, the light emitting time period of the light emitting element D can be controlled.

As shown in FIG. 7, there is a time interval between the time charging phase S4 and the light emitting phase S0, during which the pixel circuits in other rows perform data writing and charging.

The pixel driving method according to the embodiment of the present disclosure is used to drive the above-mentioned pixel driving circuit. The pixel driving method includes: generating and outputting, by a current control circuit, a driving current through a driving current output terminal. The driving time control circuit controls a light emitting time period of the light emitting element to emit light by the driving current based on the reference voltage and the first data voltage.

In the embodiment of the present disclosure, the light emitting time period of the light emitting element can be controlled by the driving time control circuit, and the light emitting time period is independent of Vf and Vth1. The problem of uneven display caused by different threshold voltages of different light emitting elements and different threshold voltages of different first driving transistors to improve display uniformity. Wherein, Vf is the threshold voltage, and Vth1 is the threshold voltage of the first driving transistor included in the first driving circuit in the driving time control circuit.

The pixel driving method according to the embodiment of the present disclosure is used to drive the above pixel driving circuit, and the display time includes a first phase, a time reset phase, a time charging phase, and a light emitting phase; the driving time control circuit includes a voltage input circuit, a first driving circuit, a first compensation circuit, a time control capacitor, and a first initialization circuit.

The pixel driving method includes the following steps.

In the first stage, the current control circuit controls to write the second data voltage to the control terminal of the second driving circuit included in the current control circuit.

In the time reset phase, the first initialization circuit controls to reset the potential of the first terminal of the time control capacitor and the potential of the second terminal of the time control capacitor, so that at the beginning of the time charging phase, the first driving circuit can control the connection of the first terminal of the first driving circuit and the second terminal of the first driving circuit under the control of the potential of the control terminal of the first driving circuit.

In the time charging phase, under the control of the first gate driving signal provided by the first gate line, the first data writing-in circuit controls to write the first data voltage Vdata1 provided by the first data line to the first terminal of the first driving circuit, the first compensation circuit controls the connection of the control terminal of the first driving circuit and the second terminal of the first driving circuit, and controls to provide the preset voltage Common1 to the first electrode of the light emitting element, and controls the connection of the second electrode of the light emitting element and the second terminal of the time control capacitor, so that the potential of the second terminal of the time control capacitor becomes Common1−Vf, and Vf is the threshold voltage of the light emitting element. The first driving circuit connects its first terminal to its second terminal, and the compensation control voltage charges the time control capacitor through the first driving circuit in an on state until the potential of the control terminal of the first driving circuit becomes Vdata1+Vth1; Vth1 is a threshold voltage of a first driving transistor included in the first driving circuit.

In the light emitting phase, the current control circuit generates and outputs the driving current through the driving current output terminal based on the second data voltage; the voltage input circuit controls to provide the reference voltage Vref to the second terminal of the time control capacitor under the control of the light emitting control signal provided by the light emitting control line EM, so as to control the potential of the control terminal of the first driving circuit to jump to Vdata1+Vref−Common1+Vf+Vth1, so that the light emitting time period of the light emitting element is not related to Vf and Vth1.

In specific implementation, in the light emitting phase, the reference voltage Vref is Vref0+K*t, where Vref0 is the initial reference voltage provided by Ref at the beginning of the light emitting phase, and t is the time difference between the time point in the light emitting phase and the start time of the light emitting phase, so that the light emitting element changes from emitting light to not emitting light.

In specific implementation, the first phase may include a current reset phase and a current charging phase, and the current control circuit includes a second driving circuit, a second initialization circuit, a second data writing-in circuit, a current control capacitor, and a second light emitting control circuit and a second compensation circuit.

The pixel driving method includes the following steps.

In the current reset phase, the second initialization circuit controls to reset the potential of the control terminal of the second driving circuit under the control of the second reset control signal, so that at the beginning of the current charging phase, the second driving circuit can connect its first terminal to its second terminal.

In the current charging phase, the second data writing-in circuit controls the connection of the second data line and the first terminal of the second driving circuit under the control of the second gate driving signal provided by the second gate line Gate, so as to write the second data voltage Vdata2 on the second data line to the first terminal of the second driving circuit. The second driving circuit connects the first terminal and the second terminal thereof, and the second compensation circuit control the connection of the control terminal of the second driving circuit and the second terminal of the second driving circuit; to charge the current control capacitor through Vdata2 to increase the potential of the control terminal of the second driving circuit until the second drive circuit disconnects its first terminal and its second terminal, at this time the potential of the control terminal of the second driving circuit is Vdata2+Vth2, and Vth2 is the threshold voltage of the second driving transistor in the second driving circuit.

A display panel according to an embodiment of the present disclosure includes the pixel driving circuit described above.

The display device according to the embodiment of the present disclosure includes the display panel described above.

The display device provided in the embodiments of the present disclosure may be any product or component having a display function, such as a mobile phone, a tablet computer, a television, a display, a notebook computer, a digital photo frame, a navigator, and the like.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel driving circuit, comprising:

a current control circuit; and a time control circuit, wherein the current control circuit is configured to control to generate a driving current, and output the driving current through a driving current output terminal, wherein the time control circuit comprises a first data writing-in circuit and a driving time control circuit, wherein the first data writing-in circuit is configured to write a first data voltage provided by a first data line to the driving time control circuit under the control of a first gate driving signal provided by a first gate line, wherein the driving time control circuit is electrically connected to a reference voltage terminal, the current control circuit, the first data writing-in circuit, and a light emitting element, respectively, and is configured to control a time period during which the light emitting element is driven to emit light by the driving current based on the reference voltage and the first data voltage, the reference voltage terminal is used to provide the reference voltage, wherein the driving time control circuit comprises a voltage input circuit, a first driving circuit, a first compensation circuit, a first initialization circuit, and a time control capacitor, wherein the voltage input circuit is configured to control to provide the reference voltage to a second terminal of the time control capacitor under the control of a light emitting signal provided by a light emitting control line, wherein a control terminal of the first driving circuit is electrically connected to a first terminal of the time control capacitor, and a first terminal of the first driving circuit is respectively connected to a driving current output terminal of the current control circuit and the first data writing-in circuit, a second terminal of the first driving circuit is electrically connected to the light emitting element, and the first driving circuit is configured to control the connection of the first terminal of the first driving circuit and the second terminal of the first driving circuit under the control of a potential of the control terminal of the first driving circuit, wherein the first data writing-in circuit is configured to write the first data voltage to the first terminal of the first driving circuit, wherein the first compensation circuit is configured to control the connection of the control terminal of the first driving circuit and the second terminal of a first driving circuit under the control of a first gate driving signal, control to provide a preset voltage to the first electrode of the light emitting element, and control the connection of the second electrode of the light emitting element and the second terminals of the time control capacitor, and wherein the first initialization circuit is configured to reset a potential of the first terminal of the time control capacitor and a potential of the second terminal of the time control capacitor under the control of a first reset control signal provided by a first reset control line.

2. The pixel driving circuit according to claim 1, wherein the driving time control circuit comprises a first light emitting control circuit, and wherein the first light emitting control circuit is configured to control the connection of the second terminal of the first driving circuit and the first electrode of the light emitting element under the control of a light emitting control signal provided by a light emitting control line, and control the connection of the second electrode of the light emitting element and the first voltage terminal.

3. The pixel driving circuit according to claim 1, wherein the first data writing-in circuit comprises a first data writing-in transistor, and wherein a control electrode of the first data writing-in transistor is electrically connected to a first gate line, a first electrode of the first data writing-in transistor is electrically connected to the first data line, and a second electrode of the first data writing-in transistor is electrically connected to the driving time control circuit.

4. The pixel driving circuit according to claim 1, wherein the voltage input circuit comprises a voltage input transistor, and wherein a control electrode of the voltage input transistor is electrically connected to the light emitting control line, a first electrode of the voltage input transistor is electrically connected to the reference voltage terminal, and a second electrode of the voltage input transistor is connected to a first electrode of the time control capacitor.

5. The pixel driving circuit according to claim 1, wherein the first driving circuit comprises a first driving transistor, and wherein a control electrode of the first driving transistor is electrically connected to a first terminal of the time control capacitor, and a first electrode of the first driving transistor is respectively connected to a driving current output terminal of the current control circuit and the first data writing-in circuit, and a second electrode of the first driving transistor is electrically connected to the light emitting element.

6. The pixel driving circuit according to claim 1, wherein the first compensation circuit comprises a first compensation transistor, a second compensation transistor, and a third compensation transistor, wherein a control electrode of the first compensation transistor is electrically connected to the first gate line, a first electrode of the first compensation transistor is electrically connected to a control terminal of the first driving circuit, and a second electrode of the first compensation transistor is electrically connected to the second terminal of the first driving circuit, wherein a control electrode of the second compensation transistor is electrically connected to the first gate line, a first electrode of the second compensation transistor is electrically connected to a preset voltage terminal, and a second electrode of the second compensation transistor is connected to the first electrode of the light emitting element, and wherein a control electrode of the third compensation transistor is electrically connected to the first gate line, a first electrode of the third compensation transistor is electrically connected to a second electrode of the light emitting element, and a second electrode of the third compensation transistor is electrically connected to the second terminal of the time control capacitor.

7. The pixel driving circuit according to claim 1, wherein the first initialization circuit comprises a first initialization transistor and a second initialization transistor, wherein a control electrode of the first initialization transistor is electrically connected to the first reset control line, a first electrode of the first initialization transistor is electrically connected to a first terminal of the time control capacitor, and a second electrode of the first initialization transistor is electrically connected to the first initialization voltage terminal, and wherein a control electrode of the second initialization transistor is electrically connected to the first reset control line, a first electrode of the second initialization transistor is electrically connected to the second terminal of the time control capacitor, and a second electrode of the second initialization transistor is electrically connected to a second initialization voltage terminal.

8. The pixel driving circuit according to claim 2, wherein the first light emitting control circuit comprises a first light emitting control transistor and a second light emitting control transistor, wherein a control electrode of the first light emitting control transistor is electrically connected to the light emitting control line, a first electrode of the first light emitting control transistor is electrically connected to a second terminal of the first driving circuit, and the second electrode of the first light emitting control transistor is electrically connected to the first electrode of the light emitting element, and wherein a control electrode of the second light emitting control transistor is electrically connected to the light emitting control line, a first electrode of the second light emitting control transistor is electrically connected to a second electrode of the light emitting element, and a second electrode of the second light emitting control transistor is electrically connected to the first voltage terminal.

9. The pixel driving circuit according to claim 1, wherein the current control circuit comprises a second driving circuit, a second initialization circuit, a second data writing-in circuit, a current control capacitor, a second light emitting control circuit, and a second compensation circuit, wherein the second light emitting control circuit is configured to control the connection of a first terminal of the second driving circuit and a first terminal of the current control capacitor under the control of a light emitting control signal inputted by a light emitting control line, and control the connection of a second terminal of the second driving circuit and a driving current output terminal, wherein a second terminal of the current control capacitor is electrically connected to a control terminal of the second driving circuit, wherein the second driving circuit is configured to control the connection of the first terminal of the second driving circuit and the second terminal of the second driving circuit under the control of a potential of the control terminal of the second driving circuit, wherein the second data writing-in circuit is configured to control the connection of a second data line and the first terminal of the second driving circuit under the control of a second gate driving signal provided by a second gate line, wherein the second compensation circuit is configured to control the connection of the control terminal of the second driving circuit and the second terminal of the second driving circuit under the control of the second gate driving signal, and wherein the second initialization circuit is configured to control the connection of a third initialization voltage terminal and the control terminal of the second driving circuit under the control of a second reset control signal provided by a second reset control line.

10. The pixel driving circuit according to claim 9, wherein the second driving circuit comprises a second driving transistor, a first terminal of the current control capacitor is electrically connected to a power supply voltage terminal, wherein a control electrode of the second driving transistor is a control terminal of the second driving circuit, a first electrode of the second driving transistor is a first terminal of the second driving circuit, and a second electrode of the second driving transistor is a second terminal of the second driving circuit, wherein the second data writing-in circuit comprises a second data writing-in transistor, a control electrode of the second data writing-in transistor is electrically connected to a second gate line, a first electrode of the second data writing-in transistor is electrically connected to a second data line, and a second electrode of the second data writing-in transistor is electrically connected to the first electrode of the second driving transistor, wherein the second compensation circuit comprises a fourth compensation transistor, a control electrode of the fourth compensation transistor is electrically connected to the second gate line, a first electrode of the fourth compensation transistor is electrically connected to a control terminal of the second driving circuit, and a second electrode of the fourth compensation transistor is electrically connected to the second terminal of the second driving circuit, and wherein the second light emitting control circuit comprises a third light emitting control transistor and a fourth light emitting control transistor, a control electrode of the third light emitting control transistor is electrically connected to the light emitting control line, a first electrode of the third light emitting control transistor is electrically connected to a first terminal of the second driving circuit, and a second electrode of the third light emitting control transistor is electrically connected to the first terminal of the current control capacitor, a control electrode of the fourth light emitting control transistor is electrically connected to the light emitting control line, a first electrode of the fourth light emitting control transistor is electrically connected to the second terminal of the second driving circuit, and a second electrode of the fourth light emitting control transistor is electrically connected to a driving current output terminal.

11. The pixel driving circuit according to claim 9, wherein the second initialization circuit comprises a third initialization transistor, a control electrode of the third initialization transistor is electrically connected to a second reset control line, a first electrode of the third initialization transistor is electrically connected to a third initialization voltage terminal, and a second electrode of the third initialization transistor is connected to the control terminal of the second driving circuit.

12. A pixel driving method for driving the pixel driving circuit according to claim 1, comprising:

generating, by a current control circuit, a driving current and outputting the driving current through a driving current output terminal; and controlling, by a driving time control circuit, a light emitting time period of the light emitting element driven by the driving current based on a reference voltage and a first data voltage.

13. The pixel driving method according to claim 12, wherein the display time comprises a first phase, a time reset phase, a time charging phase, and a light emitting phase, the driving time control circuit comprises a voltage input circuit, a first driving circuit, a first compensation circuit, a time control capacitor, and a first initialization circuit, the pixel driving method comprises:

in the first stage, controlling, by the current control circuit, to write a second data voltage to a control terminal of a second driving circuit included in the current control circuit;

in the time reset phase, controlling, by the first initialization circuit, to reset a potential of a first terminal of the time control capacitor and a potential of a second terminal of the time control capacitor;

in the time charging phase, under the control of a first gate driving signal provided by a first gate line, controlling, by the first data writing-in circuit, to write a first data voltage Vdata1 provided by a first data line to a first terminal of the first driving circuit, controlling, by the first compensation circuit, the connection of a control terminal of the first driving circuit and a second terminal of the first driving circuit, and to provide a preset voltage Commonl to a first electrode of the light emitting element, and controlling the connection of a second electrode of the light emitting element and a second terminal of the time control capacitor, so that a potential of the second terminal of the time control capacitor becomes Commonl-Vf, and Vf is the threshold voltage of the light emitting element; controlling, by the first driving circuit, the connection of the first terminal of the first driving circuit and the second terminal of the first driving circuit, and charging the time control capacitor by the compensation control voltage through the first driving circuit in an on state until the potential of the control terminal of the first driving circuit becomes Vdatal+Vthl, Vthl is a threshold voltage of a first driving transistor included in the first driving circuit; and in the light emitting phase, generating, by the current control circuit, a driving current based on a second data voltage and outputting the driving current through a driving current output terminal; controlling, by the voltage input circuit, to provide a reference voltage Vref to the second terminal of the time control capacitor under the control of a light emitting control signal provided by a light emitting control line EM, so as to control the potential of the control terminal of the first driving circuit to jump to Vdata1+Vref-Common1+Vf+Vth1.

14. The pixel driving method according to claim 13, wherein the first phase comprises a current reset phase and a current charging phase, and the current control circuit comprises a second driving circuit, a second initialization circuit, a second data writing-in circuit, a current control capacitor, and a second light emitting control circuit and a second compensation circuit, the pixel driving method comprises:

in the current reset phase, controlling, by the second initialization circuit, to reset a potential of a control terminal of the second driving circuit under the control of a second reset control signal, so that at the beginning of the current charging phase, the second driving circuit connects a first terminal and a second terminal of the second driving circuit; and in the current charging phase, controlling, by the second data writing-in circuit, the connection of a second data line and a first terminal of the second driving circuit under the control of a second gate driving signal provided by a second gate line Gate, so as to write a second data voltage Vdata2 on a second data line to the first terminal of the second driving circuit, controlling, by the second driving circuit, the connection of the first terminal and the second terminal of the second driving circuit, and controlling, by the second compensation circuit, the connection of the control terminal of the second driving circuit and the second terminal of the second driving circuit; to charge the current control capacitor through Vdata2 to increase a potential of the control terminal of the second driving circuit until the second driving circuit disconnects the first terminal and the second terminal of the second driving circuit, at this time the potential of the control terminal of the second driving circuit being Vdata2+Vth2, and Vth2 being a threshold voltage of a second driving transistor in the second driving circuit.

15. A display panel comprising the pixel driving circuit according to claim 1.

16. A display device comprising the display panel according to claim 15.

17. A pixel driving circuit, comprising:

a current control circuit; and a time control circuit, wherein the current control circuit is configured to control to generate a driving current, and output the driving current through a driving current output terminal, wherein the time control circuit comprises a first data writing-in circuit and a driving time control circuit, wherein the first data writing-in circuit is configured to write a first data voltage provided by a first data line to the driving time control circuit under the control of a first gate driving signal provided by a first gate line, wherein the driving time control circuit is electrically connected to a reference voltage terminal, the current control circuit, the first data writing-in circuit, and a light emitting element, respectively, and is configured to control a time period during which the light emitting element is driven to emit light by the driving current based on the reference voltage and the first data voltage, the reference voltage terminal is used to provide the reference voltage, wherein the current control circuit comprises a second driving circuit, a second initialization circuit, a second data writing-in circuit, a current control capacitor, a second light emitting control circuit, and a second compensation circuit, wherein the second light emitting control circuit is configured to control the connection of a first terminal of the second driving circuit and a first terminal of the current control capacitor under the control of a light emitting control signal inputted by a light emitting control line, and control the connection of a second terminal of the second driving circuit and a driving current output terminal, wherein a second terminal of the current control capacitor is electrically connected to a control terminal of the second driving circuit, wherein the second driving circuit is configured to control the connection of the first terminal of the second driving circuit and the second terminal of the second driving circuit under the control of a potential of the control terminal of the second driving circuit, wherein the second data writing-in circuit is configured to control the connection of a second data line and the first terminal of the second driving circuit under the control of a second gate driving signal provided by a second gate line, wherein the second compensation circuit is configured to control the connection of the control terminal of the second driving circuit and the second terminal of the second driving circuit under the control of the second gate driving signal, and wherein the second initialization circuit is configured to control the connection of a third initialization voltage terminal and the control terminal of the second driving circuit under the control of a second reset control signal provided by a second reset control line.

* * * * *